US005911599A

United States Patent [19]

Masuda

[11] Patent Number: 5,911,599

[45] **Date of Patent: *Jun. 15, 1999**

[54] SHIELDED CONNECTOR

[75] Inventor: Satoki Masuda, Shizuoka, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/659,185

[22] Filed: Jun. 6, 1996

[30] Foreign Application Priority Data

Jun. 6, 1995 [JP] Japan ..... 7-139425

[51] Int. Cl.[6] ..... H01R 13/648

[52] U.S. Cl. ..... 439/610; 439/578

[58] Field of Search ..... 439/607–610, 439/901, 578

[56] References Cited

U.S. PATENT DOCUMENTS

| | | | |
|---|---|---|---|
| 4,431,254 | 2/1984 | Cartesse | 439/610 |
| 5,055,070 | 10/1991 | Plegge et al. | 439/610 |
| 5,433,633 | 7/1995 | Matsumoto et al. | 439/607 |
| 5,501,615 | 3/1996 | Inaba et al. | 439/610 |

FOREIGN PATENT DOCUMENTS

| | | |
|---|---|---|
| 7245153 | 9/1995 | Japan . |
| 7263082 | 10/1995 | Japan . |
| 845613 | 2/1996 | Japan . |

*Primary Examiner*—Hien Vu

*Attorney, Agent, or Firm*—Sughrue, Mion, Zinn, Macpeak & Seas, PLLC

[57] ABSTRACT

In a shielded connector, an inner housing is disposed within an outer housing, the connected terminal of a shield wire is mounted in the inner housing, a cylindrical metal shell for covering the inner housing is inserted between the outer housing and inner housing, and the terminal is disposed in such a manner that the central axis thereof is offset with respect to the central axis of the shielded wire. In the shield connector, the outer and inner housings are connected together into a united body by means of connecting parts which are respectively provided in the offset direction.

5 Claims, 6 Drawing Sheets

SHIELDED CONNECTOR

BACKGROUND OF THE INVENTION

1. Field of the Invention

The present invention relates to a shielded connector including an inner housing and an outer housing which are integrally connected with each other into a united body by means of connecting parts.

2. Related Art

Conventionally, there is known a shielded connector of such a type that an inner housing for storing a terminal therein and an outer housing for covering the inner housing are connected together into a united body by means of connecting parts.

Now, a description will be given below of an example of the shielded connector of this type in which a spacer for detecting uninsertion of a terminal is mounted into the shield connector from the front side of the connector with reference to FIGS. 9 and 10. In particular, FIG. 9 is a longitudinal section view of a conventional shielded connector, while FIG. 10 is a front view of the conventional shielded connector.

In this conventional example, there is shown a connector of a double pole type wherein two cylindrical housings are arranged in parallel to each other.

That is, in this conventional shielded connector, a cylindrical outer housing 1 includes therein an inner housing 3 which is similarly formed in a cylindrical shape, and the outer housing 1 and inner housing 3 are connected to each other into a united body via connecting parts 5 which are respectively provided on the front right and left portions of the housings.

Between the outer housing 1 and inner housing 3, there is formed a gap 7 into which can be inserted a cylindrical metal shell 9 for covering the inner housing 3. The metal shell 9 can be mounted by securing a securing piece 9*a* thereof to a recessed portion 11 formed in the front and upper portion of the inner housing 3. Also, the rear portion of the metal shell 9 is exposed on the inner periphery of the outer housing 1 and is in contact with a contact member 17 attached by pressure to a shielded braid part 15 of a shielded wire 13.

Slightly upward of the central portion of the inner housing 3, there is formed a terminal storage chamber 19, while a male terminal 23 of the shielded wire 13 connected to a conductor of an insulated core wire 21 is mounted into the terminal storage chamber 19. An elastic securing piece 25, which is projected out toward the terminal storage chamber 19, is used to prevent the male terminal 23 from being removed from the terminal storage chamber 19. On the back surface side of the elastic securing piece 25, there is formed a spacer insertion space 27 which is opened in the front portion of the inner housing 3. If a spacer 29 is inserted into the spacer insertion space 27 from the front side of the connector, then the flexing of the elastic securing piece 25 can be regulated to thereby prevent the removal of the male terminal 23 more positively. Also, when the elastic securing piece 25 is in an incompletely secured state, then the elastic securing piece 25 is projected out into the spacer insertion space 27 to obstruct the insertion of the spacer 29, with the result that the uninsertion of the male terminal 23 can be detected.

As described above, due to provision of a terminal uninsertion detection mechanism, the terminal storage chamber 19 is situated upwardly of the central portion of the inner housing 3 and is thus shifted (offset) from the center axis of the shielded wire 13. In view of this, between the contact member 17 in contact with the metal shell 9 and the male terminal 23 stored in the terminal storage chamber 19, there is secured a given gap and the insulated core wire 21 interposed between them is bent to thereby absorb an amount of the above-mentioned shifting of the terminal storage chamber 19 with respect to the shielded wire 13.

However, in the above-mentioned conventional shielded connector, because the connecting parts 5 for connecting the outer housing 1 to the inner housing 3 are provided at the two right and left portions of the housings, especially as in electromobile specifications, in a shielded connector in which an electric wire has a large diameter, the rigidity thereof is increased and thus a repulsive force in the bent portion thereof is also increased. As a result of this, as shown in FIG. 11, there arises a problem that the rear portion of the metal shell 9 is raised up through the contact member 17. This upward displacement becomes large, especially in the male terminal 23 in which the distance between the terminal leading end thereof and the contact member 17 is long. If a male connector and a female connector are fitted with each other under such conditions, then, as shown in FIG. 12, the portion of the metal shell 9 on the male connector side thereof is inclined, to thereby greatly increase an insertion force between the male and female connectors.

In order to solve this problem, if the number of connecting parts 5 is increased, then it is necessary to increase the number of cut portions a (see FIG. 10) in the metal shell 9, which raises a new problem that the shielded area of the present connector by the metal shell 9 is decreased thereby lowering the shielding performance of the present connector. And, the increase in number of the connecting parts 5 also hinders attempts to reduce the size of the connector.

SUMMARY OF THE INVENTION

Therefore, the present invention aims at eliminating the drawbacks found in the above-mentioned conventional shielded connector. Accordingly, it is an object of the invention to provide a shield connector which prevents the rear portion of the metal shell from being raised up and thus to reduce the insertion force of the connector.

In achieving the above object, according to the invention, there is provided a shielded connector in which an inner housing is disposed within an outer housing, the connected terminal of a shielded wire is mounted in the inner housing, a cylindrical metal shell for covering the inner housing is inserted between the outer and inner housings, and the terminal is disposed in such a manner that the central axis thereof is shifted (offset) from the central axis of the shielded wire, wherein the outer and inner housings are connected together into a united body by means of connecting parts respectively disposed in the above-mentioned shifted direction.

Also, according to another aspect of the invention, there is provided a shielded connector in which an inner housing is disposed within an outer housing, the connected terminal of a shielded wire is mounted in the inner housing, a cylindrical metal shell for covering the inner housing is inserted between the outer and inner housings, and the terminal is disposed in such a manner that the central axis thereof is shifted from the central axis of the shielded wire, wherein the shield connector includes on the shielded wire connecting side thereof a position control portion for keeping the metal shell substantially at a central position thereof along the above-mentioned central axis.

According to the invention, since the connecting parts for connecting the inner and outer housings together into a united body are respectively disposed in a direction in which the terminal is shifted with respect to the shielded wire, when compared with the conventional shielded connector in which the inner housing is supported at a fulcrum in a plane intersecting at right angles to the shifted direction, the supporting force of the inner housing in the shifted direction is enhanced to thereby be able to prevent the rear portions of the inner housing and metal shell from being raised up and inclined by the repulsive force given from the bent portion of the shielded wire, which can occur in the conventional shielded connector.

Also, according to another aspect of the invention, because the position control portion for controlling the position of the metal shell is formed on the shielded wire connecting side of the shielded connector that provides the rear portion of the metal shell, similarly to the above structure, the rear portions of the inner housing and metal shell are prevented from being raised up and inclined.

DETAILED DESCRIPTION OF THE PREFERRED EMBODIMENTS

Now, a description will be given below in detail of the preferred embodiments of a shielded connector according to the invention with reference to the accompanying drawings.

Figure 1:
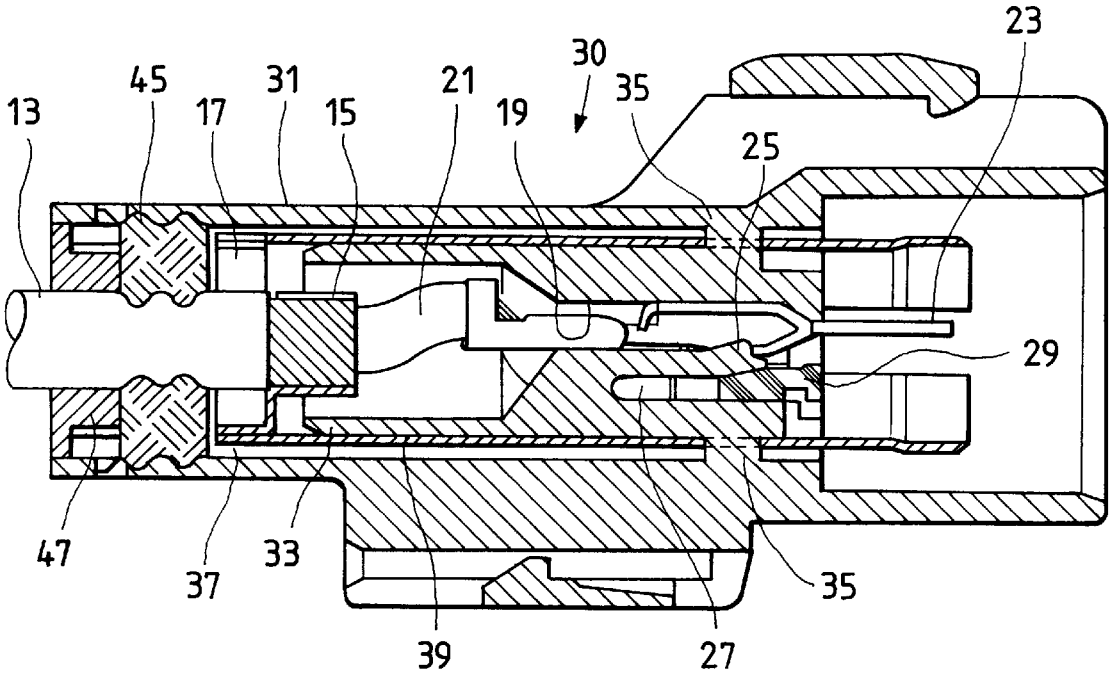
FIG. 1 is a longitudinal section view of a first embodiment of a shielded connector according to the invention.
Figure 2:
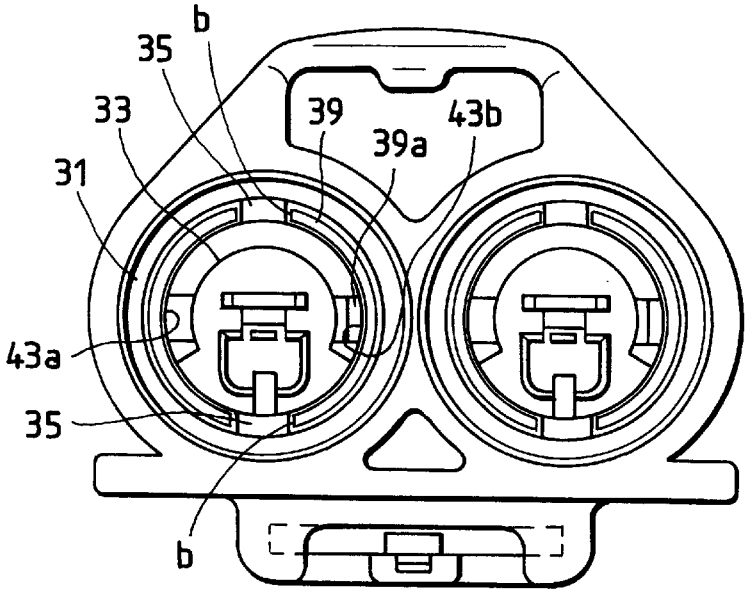
FIG. 2 is a front view of the first embodiment according to the invention.
Figure 3:
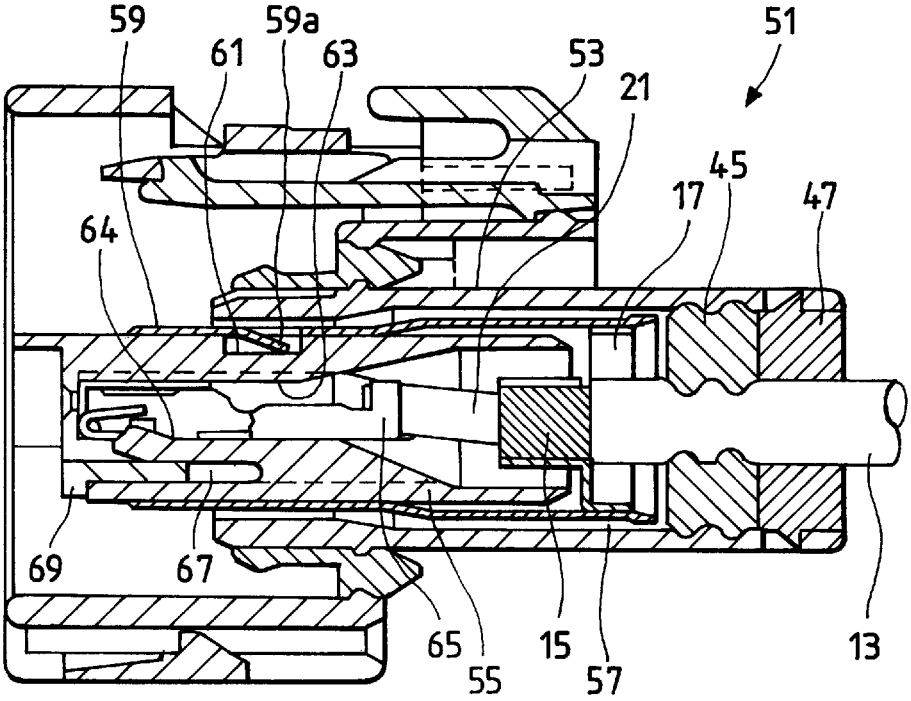
FIG. 3 is a longitudinal section view of a female connector to be fitted with a shielded connector according to the invention.
Figure 4:
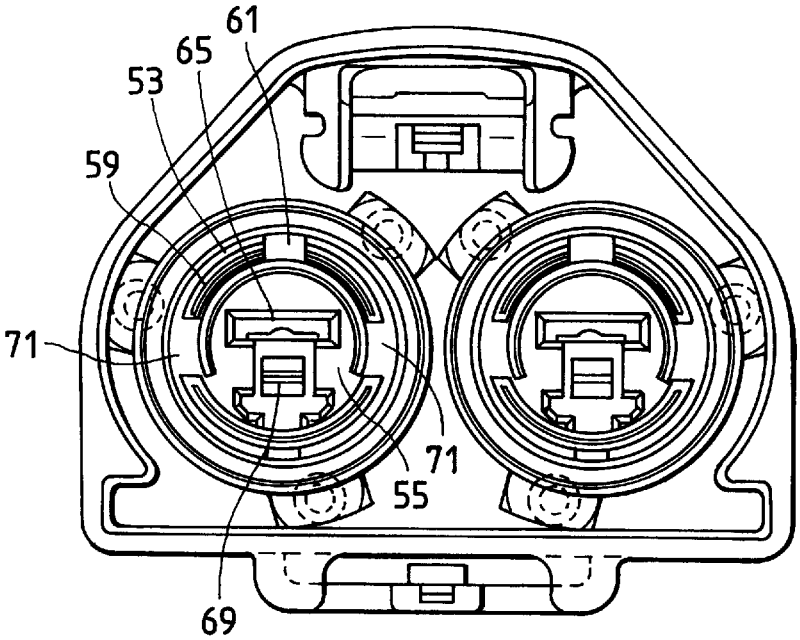
FIG. 4 is a front view of the female connector to be fitted with a shielded connector according to the invention.
Figure 5:
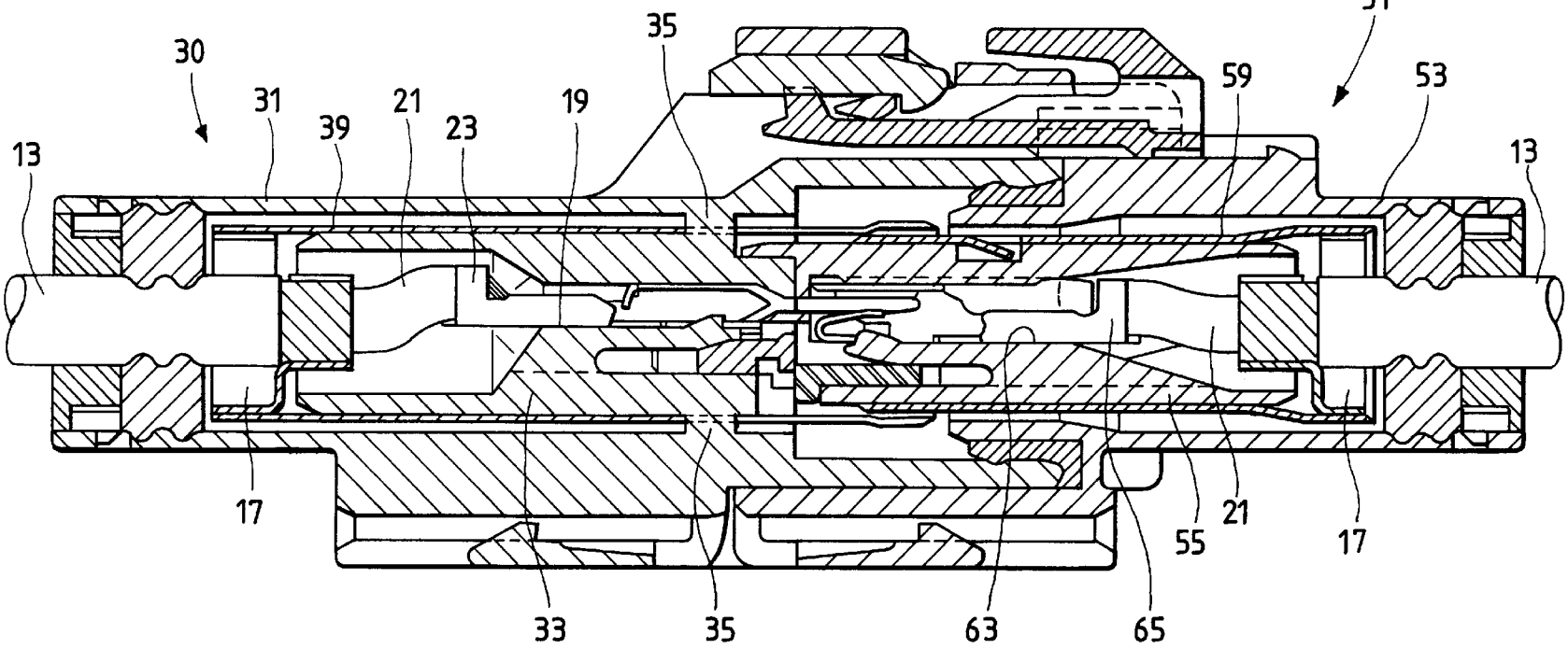
FIG. 5 is a section view of the shielded connector of the invention, showing a state thereof in which it is fitted.
Figure 9:
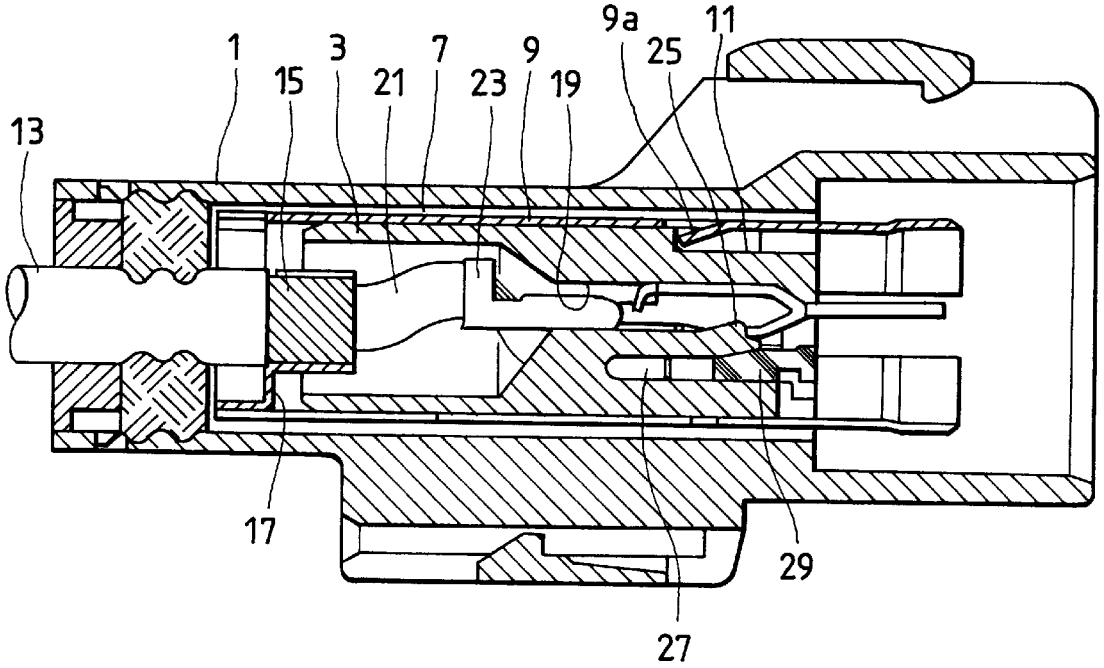
FIG. 9 is a longitudinal section view of a conventional shielded connector.
Figure 10:
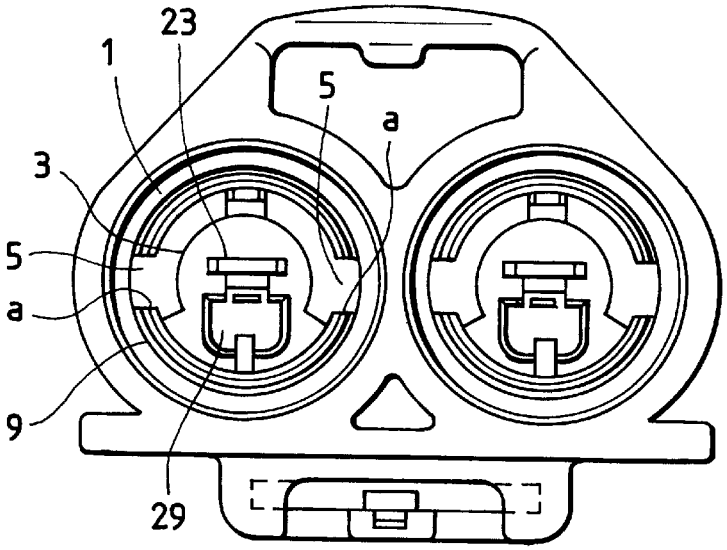
FIG. 10 is a front view of the conventional shielded connector.
Figure 11:
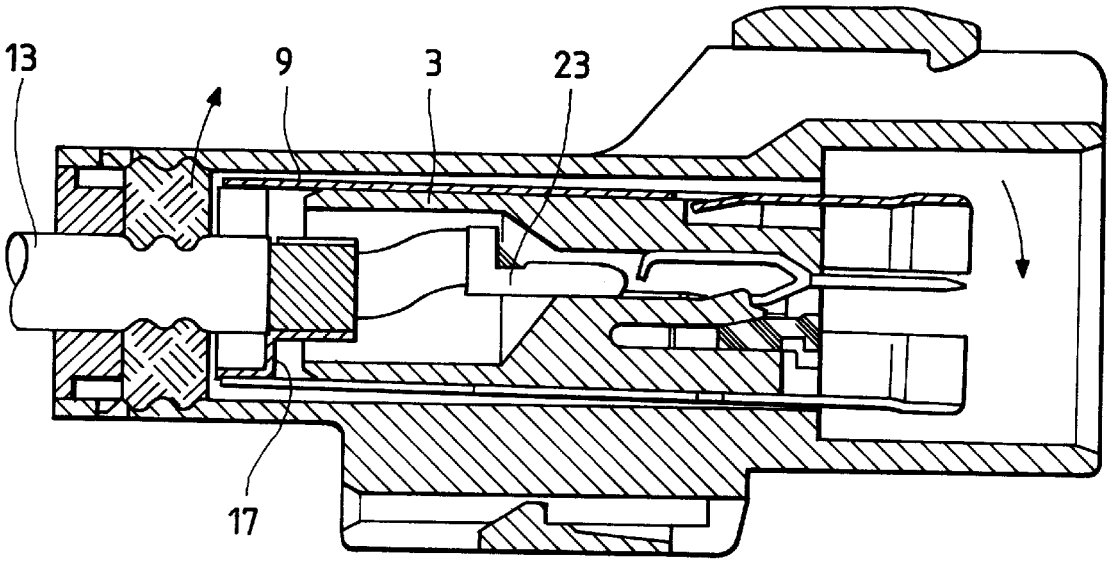
FIG. 11 is a longitudinal section view of the conventional shielded connector, explaining the shifted direction of the inner housing in the conventional shielded connector.
Figure 12:
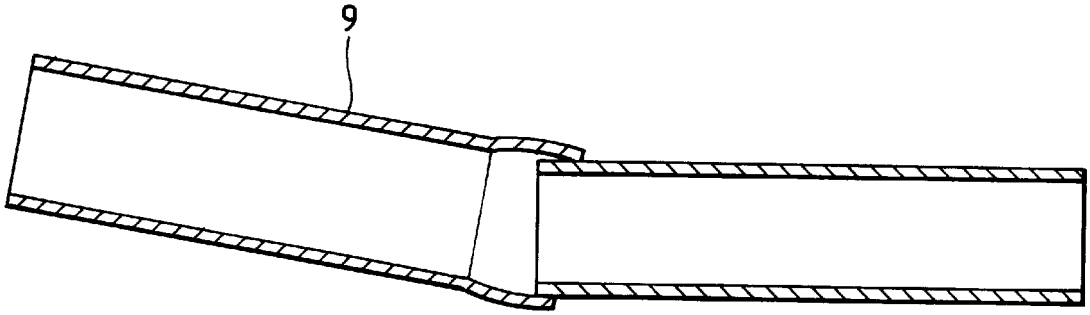
FIG. 12 is an explanatory view of the conventional shielded connector, showing a state of a metal shell which is inclined.

Specifically, FIG. 1 is a longitudinal section view of a first embodiment of a shielded connector according to the invention, FIG. 2 is a front view of the shielded connector according to the first embodiment of the invention, FIG. 3 is a longitudinal section view of a female connector to be fitted with the shielded connector according to the first embodiment of the invention, FIG. 4 is a front view of the female connector to be fitted with the shielded connector according to the first embodiment of the invention, and FIG. 5 is a section view of the shielded connector according to the first embodiment of the invention, showing a state thereof in which it is fitted. In the following description, the same parts as those shown in FIG. 9 are given the same designations and the duplicate descriptions thereof are omitted here.

According to the first embodiment, as shown in FIG. 1, a shielded connector (male connector) 30 includes a cylindrical outer housing 31 and an inner housing 33 which is similarly formed in a cylindrical shape and is disposed within the outer housing 31. The outer and inner housings 31 and 33 are connected with each other into a united body through connecting parts 35 which are disposed respectively in the front upper and lower portions of the housings. That is, according to the present embodiment, the connecting parts 35 are respectively disposed in the front upper and lower portions of the housings.

Due to this, in a metal shell 39 to be inserted into a gap 37 formed between the outer and inner housings 31 and 33, cut portions b for avoiding the connecting parts 35 are formed in the upper and lower portions of the leading end portion thereof. Also, since the connecting parts 35 are disposed in the upper and lower portions of the housings, recessed portions 43*a* and 43*b* are respectively formed in the front right and left portions of the inner housing 33. In correspondence to this, the securing piece 39*a* of the metal shell 39 is also provided, for example, on the right side of the metal shell 39 shown in FIG. 2.

In the present embodiment, the remaining components and portions thereof, that is, a shielded wire 13, shielded braid part 15, contact member 17, terminal storage chamber 19, insulated core wire 21, male terminal 23, elastic securing piece 25, spacer insertion space 27, and spacer 29 are structured similarly to those of the above-mentioned conventional shielded connector.

Also, since there is provided a terminal uninsertion detection mechanism operative to detect the obstruction of the insertion of the spacer 29 caused by the elastic securing piece 25 projecting out into the spacer insertion space 27 (see page 3) , the terminal storage chamber 19 is situated upwardly of the center of the inner housing 33 and is thereby shifted (offset) from the central axis of the shielded wire 13 when uninsertion is detected. The amount of this shift can be absorbed similarly in the conventional structure, that is, a given gap is fixed between the contact member 17 in contact with the metal shell 39 and the male terminal 23 stored within the terminal storage chamber 19, and the insulated core wire 21 disposed between them is bent. Here, fixing the given gap also fixes a distance necessary for an insulating resistance between the male terminal 23 and contact member 17.

The staking portion of the contact member 17 staking the shielded wire 13 is suitably positioned on or slightly upwardly of the central axis of the shielded wire 13.

In the present structure, a rubber stopper 45 is mounted on the portion of the shielded wire 13 that is situated in the rear of the contact member 17, while the outer periphery of the rubber stopper 45 is closely contacted with the inner periphery of the outer housing 31. And, a rear holder 47 is mounted in the rear portion of the outer housing 31 in order to prevent the rubber stopper 45 from slipping off the outer housing 31. The rear holder 47 is also used to prevent the rubber stopper 45 from being deformed unnecessarily to thereby secure a sealing property thereof when a portion of the shielded wire 13 is outside the present shielded connector.

A female connector 51, as shown in FIGS. 3 and 4, includes a cylindrical outer housing 53 and an inner housing 55 which is similarly formed in a cylindrical shape and is disposed within the outer housing 53.

Between the outer and inner housings 53 and 55, there is formed a gap 57, while a cylindrical metal shell 59 for covering the inner housing 55 is inserted into the gap 57. To mount the metal shell 59, a securing piece 59*a* of the metal shell 59 may be secured to a recessed portion 61 formed in the front upper portion of the inner housing 55. Also, the rear portion of the metal shell 59 is exposed in the inner periphery of the outer housing 53 and contacts member the contact member 17 which is pressure attached to the shielded braid part 15 of the shielded wire 13.

Slightly upwardly of the central portion of the inner housing 55, there is formed a terminal storage chamber 63, while a female terminal 65 of the shielded wire 13 connected to the conductor of the insulated core wire 21 can be mounted in the terminal storage chamber 63. An elastic securing piece 64, which is provided so as to project toward the terminal storage chamber 63, prevents the female terminal 65 from slipping off the terminal storage chamber 63. On the back surface side of the elastic securing piece 64, there is formed a spacer insertion space 67 which is opened in front of the inner housing 55. A spacer 69 is inserted into the spacer insertion space 67 from the front side of the present connector. This insertion of the spacer 69 can control the flexing of the elastic securing piece 64 to thereby prevent the removal of the female terminal 65 more positively.

In the present female connector 51 as well, due to provision of the terminal uninsertion detection mechanism, which is operative to detect the obstruction of the insertion of the spacer 69 caused by the elastic securing piece 64 projecting out into the spacer insertion space 67 (see page 3), the terminal storage chamber 63 is positioned upwardly of the center of the inner housing 55 and is thereby shifted from the central axis of the shielded wire 13 when uninsertion is detected. In view of this, the portion of the insulated core wire 21 existing between the contact member 17 and female terminal 65 is bent to thereby absorb the above shift. However, when compared with the male connector 30, the amount of shift of the female terminal 65 is less but also the distance between the leading end of the female terminal 65 and the contact member 17 is shorter and the metal shell 59 is shorter in length, so that the degree of inclination of the metal shell 59 due to such shift, is smaller. In view of this, connecting parts 71 used to connect the outer and inner housing 53 and 55 with each other, as shown in FIG. 4, are provided in the front right and left portions of the housings, similarly to the conventional male connector.

Next, a description will be given of the operation of the above-mentioned male connector 30.

In the present male connector 30, the inner housing 33 is supported or connected to the outer housing 31 at the front upper and lower portions thereof, at two points (two points existing on a vertical plane) that are positioned in the direction that the male terminal 23 is shifted relative to the wire 13, by the connecting parts 35. Due to this, even if a force in the inner housing caused by bending the shielded wire 13 is applied to the rear portion of the inner housing 33, the possibility that the inner housing 33 and metal shell 39 can be raised up and inclined as in the conventional male connector is eliminated.

As a result of this, in the male and female connectors' fitted state shown in FIG. 5, the metal shell 39 of the male connector 30 and the metal shell 59 of the female connector 51 are disposed in their mutually parallel axial directions, so an increase in the insertion force which is generated because one of the metal shells is inclined can be reduced.

As described above, in the shielded connector (male connector) 30 according to the present embodiment, since the inner housing 33 is connected to the outer housing 31 at the two points thereof existing on the vertical plane which lies in the direction in which the inner housing is shifted (upwardly), when compared with the conventional structure in which the inner housing is supported or connected to the outer housing at the two points thereof on a horizontal plane intersecting at right angles the direction that the inner housing is shifted upwardly, that is, in the front right and left portions of the housing, the rigidity thereof in the shift direction can be increased greatly to thereby prevent the inclination of the inner housing 33 and metal shell 39 caused by a repulsive force from the bent portion of the shielded wire 13. As a result of this, the connector insertion force necessary to fit the male and female connectors with each other can be reduced.

Also, due to the fact that, while the recessed portion 11 (see FIG. 9) is formed only in one portion of the inner housing 3, in conventional connectors that is, only in the upper portion thereof, in the connector 30 there are formed two recessed portions 43*a* and 43*b* for securing the securing piece 39*a* of the metal shell 39, thus eliminating the possibility of misinsertion of the metal shell 9 (that is, a state in which the securing piece 9*a* is not secured because the metal shell 9 is inserted upside down in error; either of the right and left recessed portions 43*a* and 43*b* can be secured to the securing piece 39*a*).

Figure 6:
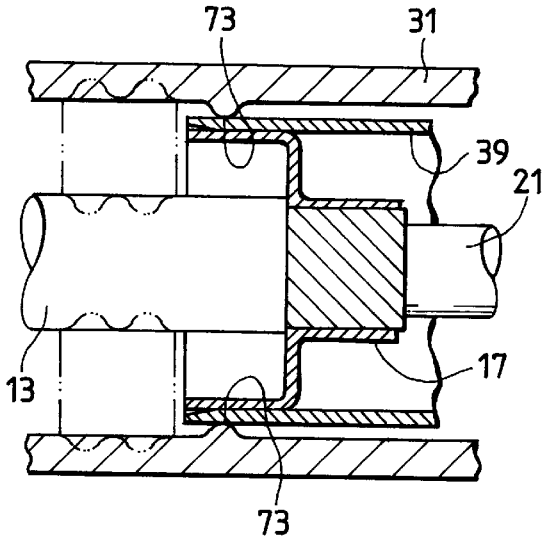
FIG. 6 is an enlarged view of the rear portion of an inner housing employed in a second embodiment of a shielded connector according to the invention, explaining the structure of the second embodiment.

Next, a description will be given of a second embodiment of a shielded connector according to the invention with reference to FIG. 6. In particular, FIG. 6 is an enlarged view of the rear portion of an inner housing employed in the second embodiment, explaining the structure of the second embodiment.

Now, the second embodiment not only includes a similar structure to the above-mentioned first embodiment wherein the inner housing 33 is supported or connected to the outer housing 31 at two points on the vertical plane, but also includes the following structure.

In the inner periphery of the rear portion of the outer housing 31, in particular, in a total of two portions including one upper portion and one lower portion thereof, there are provided projections 73 which serve to control the position (position control portions) 2 of the metal shell 39. These projections 73 are to contact the outer periphery of the metal shell 39.

Therefore, according to the second embodiment, the inner housing 33 and metal shell 39 are supported at a total of four portions including two connecting parts 35 situated on the vertical plane and two projections 73 respectively provided at the mutually spaced positions in the longitudinal direction of the present connector, which makes it possible to increase further the rigidity of the inner housing 33 and metal shell 39 due to the repulsive force from the bent portion of the insulated core wire 21.

However, the projections 73 are not limited to the above structure wherein they are provided in the two upper and lower portions of the inner periphery of the outer housing 31. That is, besides the above structure, the projections 73 can also be structured in such a manner that they are respectively formed in a ring shape and are swelled out toward the inner periphery of the outer housing 31.

Figure 7:
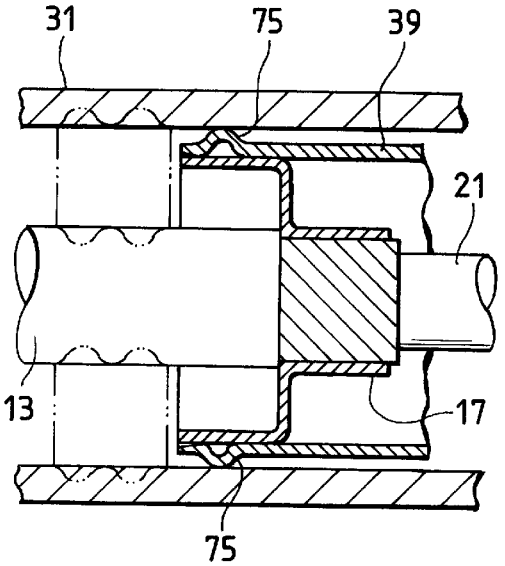
FIG. 7 is an enlarged view of the rear portion of an inner housing employed in a third embodiment of a shielded connector according to the invention, explaining the structure of the third embodiment.

Next, a description will be given of a third embodiment of a shielded connector according to the invention with reference to FIG. 7. In particular, FIG. 7 is an enlarged view of the rear portion of an inner housing employed in the third embodiment, explaining the structure of the third embodiment.

In the present embodiment, in addition to a similar structure to the previously described first embodiment wherein the inner housing 33 is supported or connected to the outer housing 31 at the two portions thereof on the vertical plane, there is further employed the following structure.

Specifically, in the outer periphery of the rear portion of the metal shell 39, that is, in a total of two portions including one upper portion and one lower portion thereof, there are provided two projections 75 which are respectively used as portions for controlling the position of the metal shell 39, while these two projections 75 are to be contacted with the inner periphery of the outer housing 31.

Therefore, according to the third embodiment, the inner housing 33 and metal shell 39 are supported at a total of four portions including the two connecting parts 35 situated on the vertical plane and the two projections 75 respectively provided at the mutually spaced positions in the longitudinal direction of the present connector, which makes it possible to increase further the rigidity of the inner housing 33 and metal shell 39 due to the repulsive force applied from the bent portion of the insulated core wire 21.

However, the projections 75 are not limited to the above structure wherein they are provided in the two upper and lower portions of the outer periphery of the metal shell 39. That is, besides the above structure, the projections 75 can also be structured in such a manner that they are respectively formed in a ring shape and are then swelled out from the inner periphery of the metal shell 39.

Figure 8:
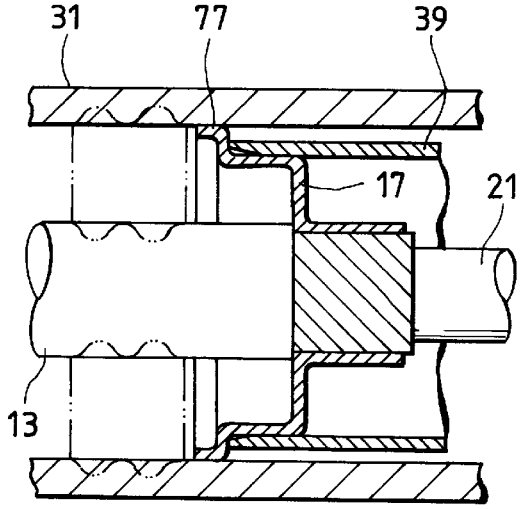
FIG. 8 is an enlarged view of the rear portion of an inner housing employed in a fourth embodiment of a shielded connector according to the invention, explaining the structure of the fourth embodiment.

Next, a description will be given of a fourth embodiment of a shielded connector according to the invention with reference to FIG. 8. In particular, FIG. 8 is an enlarged view of the rear portion of an inner housing employed in the fourth embodiment, explaining the structure of the fourth embodiment.

In the present embodiment, in addition to a similar structure to the previously described first embodiment wherein the inner housing 33 is supported or connected to the outer housing 31 at the two portions thereof on the vertical plane, there is further employed the following structure.

In the rear portion of the contact member 17, there are formed two enlarged diameter portions 77 which are respectively used as portions for controlling the position of the metal shell 39. The enlarged diameter portions 77 are respectively extended outwardly from the rear portion 39 of the metal shell 39 and the outer peripheries thereof are then contacted with the inner periphery of the outer housing 31.

Therefore, according to the present embodiment, the inner housing 33 and metal shell 39 are supported at a total of four portions including the two connecting parts 35 situated on the vertical plane and the two projections 77 respectively provided at the mutually spaced positions in the longitudinal direction of the present connector, which makes it possible to increase further the rigidity of the inner housing 33 and metal shell 39 due to the repulsive force from the bent portion of the insulated core wire 21.

As has been described heretofore, according to the shielded connector of the invention, since the inner housing is connected to the outer housing by use of the connecting parts respectively provided in the shifted direction of the terminal with respect to the shielded wire, it is possible to prevent the inner housing and metal shell from being inclined due to the repulsive force produced from the bent portion of the shielded wire. As a result of this, the metal shells of the male and female connectors can be always inserted at the same insertion center, which can reduce the connector insertion force when the male and female connectors are fitted with each other.

What is claimed is:

1. A shielded connector comprising:

an inner housing;

an outer housing in which the inner housing is disposed;

a terminal to which a shielded wire can be fixed, said terminal mountable in said inner housing, said terminal being disposed when mounted in said inner housing such that a central axis of said terminal is offset in a vertical direction in a vertical plane with respect to a central axis of said shielded wire;

a cylindrical metal shell for covering said inner housing, said cylindrical metal shell insertable between said outer and inner housings;

a connection member provided in a front portion of said metal shell for connecting said outer and inner housings together, said connecting portion provided only in said vertical plane which lies in said vertical direction; and a position control member provided in a rear portion of said metal shell for maintaining said metal shell substantially parallel to said central axis of said terminal.

2. A shielded connector as set forth in claim 1, wherein said position control member is a projection provided on an inner periphery of said outer housing in the vertical plane which lies in said vertical direction, said projection contactable with an outer periphery of said metal shell.

3. A shielded connector as set forth in claim 1, wherein said position control member is a projection provided on an inner periphery of said metal shell in the vertical plane which lies in said vertical direction, said projection contactable with an inner periphery of said outer housing.

4. A shielded connector as set forth in claim 1, wherein said position control member is a contact member fittable within an inner periphery of the rear portion of said metal shell, said contact member having a first enlarged diameter portion whose outer periphery contacts an inner periphery of said metal shell, and a second enlarged diameter portion whose diameter is greater than said first enlarged diameter portion, an outer periphery of said second enlarged diameter portion closely contacting an inner periphery of said outer housing.

5. A shielded connector as set forth in claim 1, further comprising a spacer;

wherein said terminal comprises a retaining projection;

wherein said inner housing comprises an elastic securing piece engageable with said retaining projection to retain said terminal in said inner housing, and further comprises an insertion space; and wherein said spacer is fully insertable in said insertion space only when said terminal is retained in said inner housing.

* * * * *